United States Patent [19]

Sulmont et al.

[11] Patent Number: 4,857,157

[45] Date of Patent: Aug. 15, 1989

[54] PROCESS AND APPARATUS FOR CONTROLLING SOLID ELECTROLYTE ADDITIONS TO ELECTROLYTIC CELLS FOR ALUMINUM PRODUCTION

[75] Inventors: Benoît Sulmont; Alain Paternoga, both of St Jean De Maurienne, France

[73] Assignee: Aluminium Pechiney, Paris, France

[21] Appl. No.: 182,499

[22] Filed: Apr. 18, 1988

[30] Foreign Application Priority Data

Apr. 21, 1987 [FR] France ..... 87 05874

[51] Int. Cl.[4] ..... C25C 3/06; C25C 3/20

[52] U.S. Cl. ..... 204/67; 204/245; 204/225

[58] Field of Search ..... 204/67, 243 R–247, 204/225

[56] References Cited

U.S. PATENT DOCUMENTS

| | | | |
|---|---|---|---|
| 3,616,432 | 10/1971 | Day | 204/245 X |
| 3,899,402 | 8/1975 | Chaudhuri | 204/67 |
| 3,900,371 | 8/1975 | Chaudhuri | 204/67 |
| 4,675,081 | 6/1987 | Girard | 204/245 X |

FOREIGN PATENT DOCUMENTS

| | | | |
|---|---|---|---|
| 387028 | 10/1973 | U.S.S.R. | 204/245 |

*Primary Examiner*—Donald R. Valentine

*Attorney, Agent, or Firm*—Dennison, Meserole, Pollack & Scheiner

[57] ABSTRACT

Process and apparatus for controlling solid electrolyte additions to electrolytic cells for aluminum production.

The invention relates to a process for controlling solid electrolyte additions to a cell for producing aluminum by the electrolysis of alumina dissolved in a molten cryolitic bath according to the Hall-Héroult process.

According to this process a nominal value HBC is fixed for the bath height, the level of the bath in the cell is periodically determined on the basis of a fixed dimension point PF known relative to the carbon-containing cathode substrate, from it is deduced the total height HT of the electrolytic bath layer HB and the liquid aluminum layer HM, the thickness HM of the liquid aluminum layer on the cathode substrate is determined, from it is deduced the bath layer height HB, HB=HT−HM and Hb is compared with the nominal value HBC.

If this comparison reveals a bath deficiency, a ground bath addition is initiated from a storage means through at least one opening made in the solidified electrolyte crust normally covering the cell. If this comparison reveals a bath excess, an alarm is triggered in order to bring about a bath tapping operation.

9 Claims, 2 Drawing Sheets

FIG.3
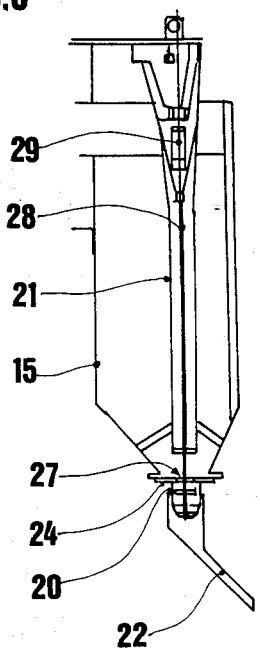
FIG.4
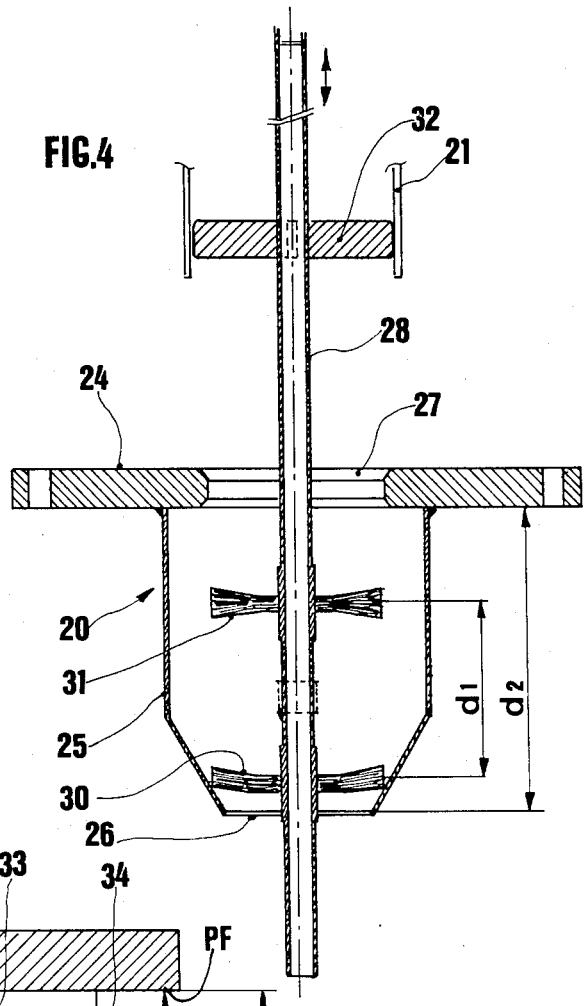
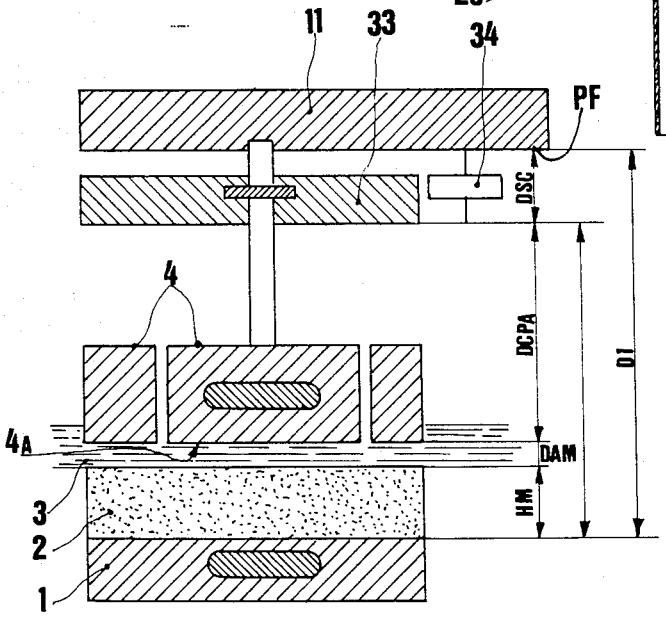
FIG.5

PROCESS AND APPARATUS FOR CONTROLLING SOLID ELECTROLYTE ADDITIONS TO ELECTROLYTIC CELLS FOR ALUMINUM PRODUCTION

TECHNICAL FIELD OF THE INVENTION

The invention relates to the production of aluminium by electrolysis of alumina dissolved in the melted cryolite in accordance with the Hall-Héroult process and more specifically to a process and an apparatus for controlling solid electrolyte additions to electrolytic cells.

STATE OF THE ART

The operation of modern electrolytic cells for the production of aluminium according to the Hall-Héroult process requires permanent monitoring of the volume of the bath. Most of this bath is in the molten state and constitutes the electrolyte, the remainder in solidified form forming the lateral slopes and the crust covering the free surface of the electrolyte. The latter is essentially constituted by cryolite $Na_3AlF_6$ and can have various additives such as $CaF_2$, $AlF_3$, LiF, etc., which influence the melting point, the electrochemical properties and the capacity to dissolve alumina.

The electrolyte volume must be adequate to ensure rapid dissolving and distribution of the alumina introduced into the cell, but must not exceed a certain level beyond which it would lead to corrosion of the steel rods on which are suspended the anodes, with the consequence of an increase in the iron content of the aluminium produced and to a more frequent replacement of corroded steel rods.

Thus, periodic checks are made on the position of the free surface of the electrolyte and to the interface between the electrolytic bath and the cathodic liquid aluminium layer.

The adjustments of the bath volume in each cell are performed:

- either by addition, if the level is too low:
  - of new solid products (essentially the cryolite $Na_3Alf_6$), recycled solid products (solidified and ground electrolytic bath resulting from the cleaning of spent anode butts and cell cathodes, which are out of service before demolition and which will subsequently be referred to by the term "ground bath"), liquid electrolytic bath taken from other cells in the series;
- or by removal, if the level is excessive, the liquid bath being reused as it is, after a short interval, for an addition to other cells, or is solidified, ground and stored for subsequent recycling.

In general, in order to avoid the risk of a disequilibrium due to bath deficiency, the operator will choose to operate with a slight excess and will bringabout corrections by regular tapping of the liquid bath, the term "tapping" here being understood to mean the extraction in the liquid state.

Bath additives to the cell take place systematically by covering the anodes (with a view to their thermal insulation), by adding fluoride products ($AlF_3$, cryolite) and recycling the alumina used for collecting fluoric effluents in the devices for the purification of the gases emitted by the electrolytic cells.

These additions are compensated by emissions (gases and dust) from the cell and the withdrawals are decided as a function of level measurements carried out by the operators at intervals of approximately 24 to 48 hours.

DISADVANTAGES OF THE PRIOR ART

At present, bath additions are subject to significant and poorly controlled fluctuations, more particularly due to the time which elapses between the addition of ground bath covering the anodes and its passage into the molten state in the cell. This leads to significant bath height variations and to extensive liquid bath handling operations, which cause variations prejudicial to the thermal equilibrium of the cells.

Moreover, these handling operations of the liquid bath, the crushing operations, and the resulting ground bath handling operations, together with the bath level measurements are generally manual operations with a poor productivity level, which are prejudicial to production costs and involve the use of expensive and cumbersome equipment.

European Patent application EP-A-No.195143 describes a process for measuring the electrolyte level in a Hall-Héroult electrolytic cell, according to which an anode of the cell, into which passes a given current, is progressively raised and the reduction in the current as a function of the raising height is measured and the height for which the current has dropped to a predetermined fraction of its initial value is noted. By calibration, it is possible to deduce therefrom the real depth of the electrolyte layer. This process is based on a completely different principle to that of the present invention, which requires no anode movement.

OBJECT OF THE INVENTION

The basic idea of the present invention consists of carrying out an indirect measurement of the height of the molten bath layer on the basis of the measurement of the total height of the molten metal layer and the molten bath layer surmounting it, with respect to the cathode substrate taken as the reference plane and an evaluation of the height of the molten metal layer which, by subtraction, gives the height of the molten bath layer.

The position of the upper face of the cathode substrate (formed by juxtaposing carbon-containing cathode blocks) with respect to the other fixed elements of the metal structure involving the case, the superstructure of the cell and the anode frame, or the equivalent collective or individual or groupwise suspension device of the anodes is accurately known from the design. This position can vary during the life of the cell (raising as a result of swelling of the cathode blocks or their substrate, or wear to the said surface by erosion), but in any case such effects are very slow (approximately 1 mm per month), which is not prejudicial for comparative measurements on the scale of a few days or weeks and which are periodically recalibrated by a physical measurement of said basis level.

It is possible to use as the reference level, a fixed point e.g. located on the rim of the potshell on a vertical post or a horizontal beam of the superstructure and whereof the vertical dimension with respect to the carbon-containing cathode substrate is accurately known. It is sufficient to measure the level of the molten bath with respect to said fixed dimension point in order to immediately deduce therefrom the total height HT of the metal layer (HM) and the molten bath layer (HB).

This level measurement could be performed by different direct devices, such as electric contact with the bath surface, or alternatively indirect devices, such as proximity effect, light, hertzian or ultrasonic telemetry on the bath surface, preferably through an opening made in the solidified electrolyte crust, which in normal operation covers the electrolytic cell.

Therefore a first object of the invention is a process for the control of solid electrolyte additions to a cell for the production of aluminium by the electrolysis of alumina dissolved in a molten cryolitic bath according to the Hall-Héroult process, between a carbon-containing cathode substrate on which is formed a liquid aluminium layer and a plurality of carbon-containing anodes supported by a regulatable anode frame or by an equivalent system in height with respect to a fixed superstructure, characterized in that with a view to limiting fluctuations of the electrolytic bath level to approximately +1 cm, a nominal value HBC for the bath level is fixed, the bath level in the cell is periodically determined on the basis of a fixed dimension point PF known with respect to the carbon cathode substrate and located on the rigid assembly constituted by the metal case and the superstructure of the cell, from it is deducted the total height (HT) of the bath layer (HB) and the liquid A1 layer (HM) on the cathode substrate, on the basis of the fixed point dimension with respect to the cathode substrate, the thickness HM of the liquid layer A1 on the cathode substrate is determined, from it is deduced the height of the layer of the bath HB=HT−HM and HB is compared with the nominal value HBC.

If this comparison reveals a bath deficiency, a ground bath addition is initiated, whereas if a bath excess appears, an alarm is triggered, said succession of operations being performed in a sufficiently short time to ensure that HT, HB and HM do not have enough time to significantly vary, i.e. in a proportion comparable with the precision of said measurements.

Preferably, the measurement of the bath level in the cell takes place by establishing an electric contact between the surface of bath 3 and a dresser 7, which moves relative to the fixed superstructure 11, in accordance with a vertical axis and linked with the cathode substrate by a low value resistor.

When this contact is established, the distance D3 covered by the dresser in its downward movement as from its top position is noted:

the height of the liquid aluminium layer 2 is determined on the basis of parameters:

D1: distance between superstructure 11 of the cell and the cathode substrate 1, DSC: distance between superstructure 11 and anode frame 33, DSCPA: distance between anode frame 33 and anode plane 4A

DAM: distance between anode plane 4A and the layer by the relation HM=D1−(DSC+DSCPA+DAM), from it is deduced the real height of the molten bath 3 on the basis of parameters:

D1: distance between the cathode substrate 1 and the superstructure 11 of the cell, D2: distance between the superstructure 11 and the top position of dresser 7, D3: travel of dresser 7 between its top position and its position at the instant of electric contact with the liquid bath, HM: height of the liquid A1 layer on the cathode substrate by applying the relation HB=(D1−D2−D3)−HM the value of HB is compared with the nominal value HBC, if this comparison reveals a bath deficiency, a ground solid bath addition is initiated from a storage means using at least one opening made in the solidified electrolytic bath crust normally covering the electrolytic cell, if this comparison reveals a bath excess, an alarm is triggered in order to bring about a liquid bath tapping operation.

A second object of the invention is an apparatus for performing the aforementioned process and which comprises a means for measuring the total height (HT) of the aluminium layer and the molten electrolyte surmounting the same, HB+HM, a means for measuring the height HM of the aluminium layer on the cathode substrate, a means for comparing height HB with a nominal value HBC and a ground bath storage hopper located on the electrolytic cell and provided in its lower part with a distributor-doser controlled by a device connected to the means for comparing the height of bath HB with its nominal value.

The aim of the invention is to optimize the electrolyte level and to maintain it very close to the nominal value, which reduces risks of corrosion to the anode rods due to an excessive level and the risks of undissolved alumina mud forming on the cathode substrate (if said level is inadequate). The invention in general terms aims at avoiding any large excess of the nominal value, because a bath excess is more difficult to correct than a bath deficiency and the consequences of an excess are in principle more prejudicial than those of a deficiency. Moreover, the total value of the electrolytic bath in a series represents an important immobilization of capital and should be reduced to the greatest possible extent.

According to the prior art and the conventional operating conditions, the bath level tends to constantly increase and it frequently occurs that several dozen kilograms of bath have to be tapped per tonne of aluminium produced. As this operation is relatively difficult, it is only carried out when the nominal value of the level has been exceeded by several centimetres (e.g. 4 to 5 cm). According to the invention, it is possible to maintain the fluctuations around the reference value to approximately ±1 cm, so that for the same nominal value, the average bath level according to the invention, over a long period, is below the average bath level according to the prior art.

To the extent that the systematic bath additions are at the most equal to the discharges by emissions (gases, dust) and crusts removed with spent anodes, it is possible to obviate any bath tapping over a long period.

DESCRIPTION OF THE DRAWINGS

FIGS. 1 to 5 illustrate the invention.

FIG. 1 is a diagrammatic section of the device for measuring the level of the electrolytic bath in the cell.

FIG. 2 in diagrammatic section along the major axis of the cell shows the alumina storage hoppers and the distributors-dosers associated therewith, one of them being twined with a ground bath distributor-doser.

FIG. 3 in greater detail and in section, shows the ground bath distributor-doser.

FIG. 4 shows on a larger scale the addition dosing system.

FIG. 5 diagrammatically and in section shows the principle of measuring the metal height in the cell. From bottom to top, FIG. 1 shows the cathode substrate 1 on which is formed the liquid aluminium layer 2, surmounted by the cryolite-based electrolytic bath 3, in which is immersed anode 4. In normal operation, a solidified electrolyte crust 5 covers the electrolytic bath 3, at a limited distance therefrom and over the entire free surface, around the anodes and up to the side slopes, with the exception of a certain number of openings 6 which are kept permanently open, under the action of perforating jacks in order to ensure the discharge of gases produced by the electrolytic process and in order to permit the introduction of alumina and various additives during electrolysis.

Figure 1:
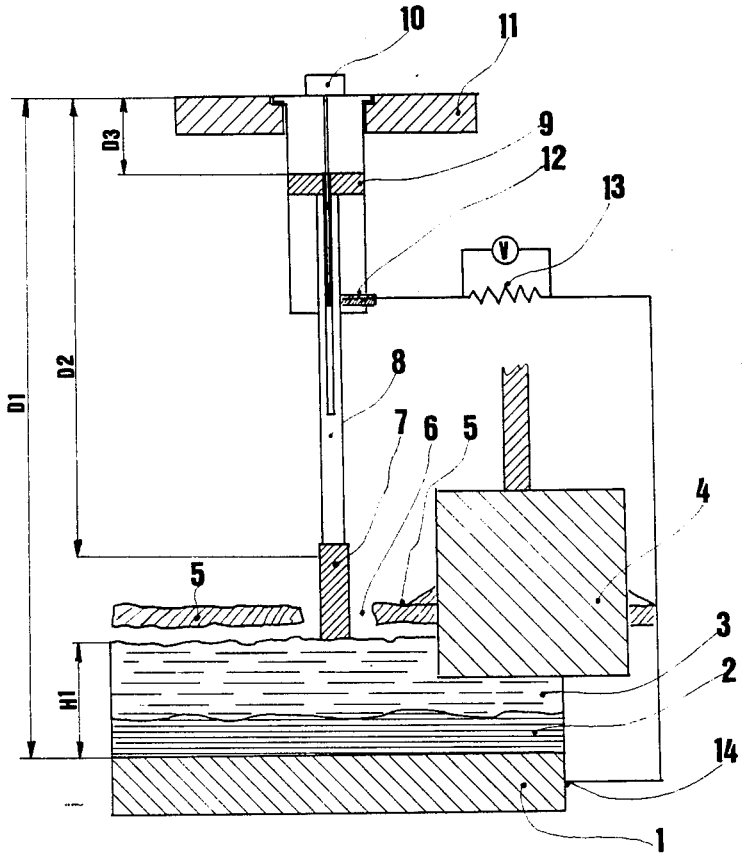

The dresser 7, located at one end of a rod 8, can move along a substantially vertical axis under the action of jack 9 associated with a displacement transducer 10. Said device is fixed to the superstructure 11 of the cell constituting a fixed reference level. Dresser 7 must be electrically insulated from the superstructure.

A rubbing electric contact 12 cooperates with the moving rod 8. It is connected via a low value resistor 13 (approximately 1 k Ω for example) to a socket or connector 14 in the cathode substrate. As references are used:

D1: distance between the cathode substrate 1 and the cell superstructure 11 (known by design)

D2: distance between the superstructure 11 and the high position of the dresser 7 (maximum raising of jack 9).

With the dresser raised to its maximum level, it is progressively lowered, whilst measuring the potential difference at the terminals of resistor 13. This is substantially equal to zero initially. The displacement transducer 10 displays the course of the dresser in its downward movement. At the instant where contact takes place between the dresser and the free electrolyte surface, the potential at the terminals of resistor 13 rises suddenly. The course or travel of the dresser at this instant is noted, i.e. D3. It is then known that the total height of the bath and the metal HB+HM is equal to D1−D3. As the metal height HM is assumed as known (by a process described hereinafter), the height of the bath is deduced therefrom: HB+HM=D1−D3−D2. This value HB is introduced in known manner into the computer, which produces the ground bath addition instructions, as a function of the difference between the measured HB and the nominal value HBC.

This HB measuring process and apparatus have the advantage of being simply performed and in particular of only causing a brief contact between the molten bath and the dresser, which is raised as soon as value D3 is obtained and whose life is consequently very long. Another advantage is that this measurement makes it possible to check that the supply opening 6 is indeed open. A diverging voltage value at the terminals of resistor 13, or the impossibility of acquiring said value can trigger an alarm and/or a device for opening the hole (perforating device controlled by a jack).

Finally, as the downward movement of dresser 7 is stopped as soon as it is in contact with the liquid bath, there are economies in the air required for supplying jack 9.

Figure 2:
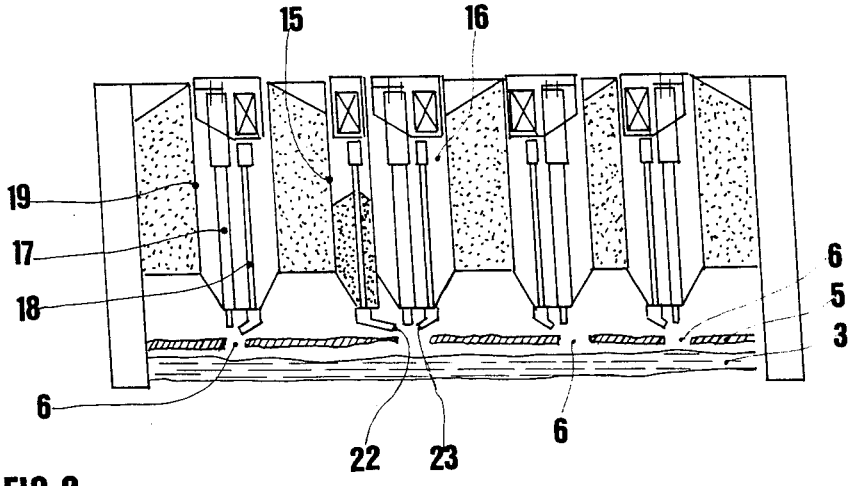

FIG. 2 shows the hopper 15 containing the ground bath, which is associated with one of the alumina distributors 16. These distributors have been described in French Patent FR-B-No.2527647 (=U.S. Pat. No. 4,437,694), in the name of Aluminium-Pechiney. They are formed by associating a perforating device 17 and a distributor-doser 18 detachably arranged in a tight sleeve 19.

FIG. 3 shows the position of the ground bath distributor 20 at the bottom of hopper 15. The ground bath distributor-doser 20 is also located in a tight sleeve 21 and its distributor 22 issues into the vicinity of the alumina distributor 23 above an opening 6.

FIG. 4 shows details of the doser, which differs significantly from alumina dosers, e.g. that described in our European Patent EP-No.44794-B1 (=U.S. Pat. No. 4,431,491). Thus, the ground bath does not have the same fluidity qualities as the alumina. Moreover, as said bath is recovered in the form of solid blocks, its grinding to a very fine grain size (e.g. less than 1 mm) would be a costly and dust-producing operation.

It is therefore preferable to grind it to an average grain size (e.g. 0 to 6 mm or 0 to 10 mm) and to design the distributor-doser in such a way that it cannot remain blocked in an intermediate position, which would lead to the complete emptying of the ground bath hopper and to a significant disturbance to the thermal equilibrium of the cell.

The apparatus illustrated in FIG. 4 meets this requirement. It comprises a plate 24 fixed to the bottom of hopper 15, e.g. by bolting. Beneath said plate is fixed the dosing bucket 25 formed by a tubular body, whose volume corresponds to a predetermined ground bath weight and which can be between 0.5 and 5 kg, e.g. 2 kg. The lower end 26 is open and is extended by the supply tube 22 issuing above opening 6. The upper part 27 issues into the hopper. An axial rod 28 is connected in its upper part to a jack 29 and carries in its lower part two lower and upper closing or sealing means 30,31, which are spaced by a distance D1 less than the distance D2 between the upper end lower openings of the dosing bucket 25.

Stoppers 30 and 31 are formed by flexible disks centred on rod 28. It is advantageously possible to use metal brushes constituted by interlaced steel wires (rotary brushes), or disks of flexible material, such as felt, either as it is or rigidified somewhat by an e.g. wire gauze reinforcement, or of hard rubber or synthetic elastomers, optionally reinforced with steel wires, or equivalent alloys.

Rod 28 is guided at the base of sleeve 21, e.g. by a gentle friction ring 32, which substantially prevents any rising of the ground bath in the sleeve 21. In the bottom position, stopper 30 bears on the rims of the opening 26, or on the base of the cone forming the lower part of bucket 25. In this position, bucket 25 is filled with ground bath. When returned to its upper position under the action of jack 29, the upper stopper 31 bears against the rims of the opening 27, thus bringing about an insulation of the hopper, whilst the content of bucket 24 flows into opening 6.

The flexibility and elasticity of stoppers 30,31 make it possible to ensure the necessary sealing action, even if a few ground bath grains remain attached to the rims of the openings, thus preventing any partial or total, accidental emptying of the hopper 15 into the cell.

Jack 29 is connected to the computer, as stated hereinbefore, so as to come into action for any signal indicating that the bath level is below the nominal value.

FIG. 5 shows the principle of measuring the metal level.

It was stated hereinbefore that the apparatus of FIG. 1 permitted a precise and rapid measurement of the total height of the bath+metal (HB+HM). It is standard practice to measure the bath and metal height in a cell by a manual process consisting of rapidly introducing a metal rod into the cell until contact takes place with the cathode substrate and then to remove it for a few seconds. After cooling, it is possible to distinguish with the eye the solidified electrolyte and metal, whose respective heights are to be measured. This manual measurement is not compatible with an automation of the process.

According to the invention, the height HM of the liquid aluminium layer is measured by reference to a known, fixed dimension point, with respect to the cathode substrate, i.e. edge of the case, vertical post or horizontal beam. The process will be described in the particular case where the reference point is located on superstructure 11, but this in no way limits the invention.

By design, D1 the distance between the superstructure 11 and the cathode 1 is known. DSC (distance between superstructure 11 and anode frame 33, movable heightwise in order to regulate the anode-cathode spacing of the cell) is known, as a result of a device, such as the potentiometric displacement transducer 34. DCPA, i.e. the distance between the anode frame 33 and the anode plane 4A is known on the basis of the anode wear rate, which is relatively accurately known and remains constant in normally operating cells for a given anode quality. Finally, DAM, the distance between the anode and the metal is known, this being considered as constant for a given nominal value of the internal strength of the cell under normal operating conditions and when there are no disturbances (such as anode effect, removal of metal, changing anodes, raising the frame, etc.,).

Therefore the metal height HM is:

$$HM = D1 - (DSC + DCPA + DAM)$$

As stated hereinbefore, the bath height HB is deduced therefrom:

$$HB = (D1 - D2 - D3) - HM$$

In the case where the cell has a motorization of the anodes either individually or in groups of 2 or 4, the height references DSC and DCPA will be taken on one of the elements common to a group of anodes and not on the anode frame.

PERFORMANCE EXAMPLE

With respect to a series of cells operating at an intensity of 280 KA, over several months was taken a tapped bath quantity of approximately 40 to 80 kg per tonne of aluminium produced (approximately 2100 kg of Al per cell and per day) with a nominal value of the bath height HB=20 cm and fluctuations of +5/−2 centimetres. After realizing the invention, the nominal value of HB remaining fixed at 20 cm, the fluctuations were reduced to ±1 cm and there was no bath tapping during the last six months.

ADVANTAGES RESULTING FROM THE INVENTION

Apart from the advantages referred to during the description, the performance of the invention leads to significant improvements in connection with the operation of electrolytic cells:

1. Due to the fact that the ground bath is now added from a hopper and a distributor-doser, it is no longer necessary for covering the cell (thermal insulation of the anodes) to form crushed bath mixtures (possibly plus fluoric additives) and so-called process alumina (i.e. fluorine-containing alumina from devices for collecting effluents emitted by the electrolytic cell). Henceforth this covering can take place exclusively with process alumina.

2. The bath height can be maintained within narrow limits of typically +1 cm on the daily mean values, instead of +4 or 5 cm according to the prior art.

3. The nominal height change of the bath is very easy, it only being necessary to modify one instruction on the cell microprocessor.

4. Henceforth it is possible to operate without fear using lower average bath heights, all the other conditions remaining identical.

5. This drop in the average level of the bath and this limitation of the maximum level has as its direct consequence an improvement in the regularity of the fineness of the metal (significant drop in the iron content).

6. Productivity gains with regards to the manual measurements of height, transfers and crushing of the bath and on the collecting of fluoric effluents on the bath circuits (molten bath tapping, crushing dust, etc.).

7. Automation of the ground bath additions, including from ground bath bins, if there is a system for moving the bin to the cells.

We claim:

1. Process for controlling solid electrolyte additions to a cell for the production of aluminium in the Hall-Heroult process, by electrolysis of alumina dissolved in a molten cryolite bath 3 between a carbon-containing cathode substrate 1 having a liquid aluminium layer 2 thereon and a plurality of carbon-containing anodes 4 supported by an anode frame 33 having a height which can be regulated with respect to a fixed superstructure 11, comprising fixing a nominal value HBC for the bath height, periodically determining the distance between the top of the bath in the cell and a fixed reference point PF thereabove of known location with respect to the carbon-containing cathode substrate, determining from said distance the total height HT of the electrolytic bath layer HB and the liquid aluminium layer HM, determining the thickness HM of the liquid A1 layer on the cathode substrate from the bath layer height HB, where HB=HT−HM and comparing HB with the nominal value HBC and if said comparison reveals a bath deficiency, initiating ground bath addition from a storage means, through at least one opening made in the solidified electrolyte crust normally covering the cell, and if said comparison reveals a bath excess, tapping said bath, whereby fluctuations in the level of the bath can be limited to about +1 cm.

2. Process according to claim 1, wherein the bath level in the cell is measured by a means selected from the group consisting of a direct electric contact, a proximity effect, and light, hertzian and ultrasonic telemetry.

3. Process according to claim 2, wherein the bath level in the cell is measured by establishing an electric contact between the surface of the bath 3 and a dresser 7, which moves relative to the fixed superstructure 11 along a vertical axis and electrically linked with the cathode substrate by a low value resistor.

4. Process according to claim 1, characterized in that the height of the liquid aluminium layer 2 is determined on the basis of parameters:

D1: distance between the cell superstructure 11 and the cathode substrate 1, DSC: distance between superstructure 11 and anode frame 3, DSCPA: distance between anode frame 33 and anode plane 4A, DAM: distance between anode plane 4A and liquid aluminium layer 2, by the relation: HM=DI−(DSC+DSCPA+DAM);

the real height of the molten bath is deduced on the basis of the parameters:

D1: distance between the cathode substrate 1 and the cell superstructure 11, D2: distance between superstructure 11 and the top position of dresser 7, D3: travel of the dresser 7 between its top position and its position at the time of electric contact with the liquid bath, HM: height of the liquid aluminium layer on the cathode substrate, by applying the relation: HB=(D1−D2−D3)−HM.

5. Process according to claim 1, 2, 3 or 4 wherein the ground bath addition takes place from a hopper, located on the cell and provided with a distributor-doser connected to means for comparing the real height of the bath and the nominal value of said height.

6. Apparatus for controlling solid electrolyte additions to electrolytic cells, for the production of aluminum according to the Hall-Heroult process, said cells comprising a carbon-containing cathode substrate, a plurality of carbon-containing anodes supported by an anode frame, a fixed superstructure, with respect to which the height of the anode frame can be adjusted, a liquid aluminum layer on said substrate and a molten cryolite bath between said anodes and the liquid aluminum layer, said apparatus comprising a means for measuring the distance between the top of the molten electrolyte and a reference point thereabove of known location with respect to said substrate, means for determining the total height HB+HM of the aluminum layer and the molten electrolyte surmounting it, based on the measured distance, a means for measuring the height of HM of the aluminum layer on the cathode substrate, and computing therewith molten electrolyte height HB, a means for comparing height HB with a nominal value HBC, a ground bath storage hopper located on the electrolytic cell and provided in its lower part with a distributor-doser controlled by a device connected to the means for comparing the height of the bath HB with the nominal value.

7. Apparatus according to claim 6, comprising a dresser 7 located at the end of a rod 8 connected to a vertically axed jack 9, associated with a displacement transducer 10 and fixed to the superstructure 11 of the cell, the dresser 7 being electrically insulated from superstructure 11, rod 8 cooperating with an electric contact 12, connected via a low value resistor 3 to a connector 4 in the cathode substrate.

8. Apparatus according to claim 6, wherein the ground bath distributor-doser incorporates a dosing bucket 25 constituted by a vertically axed body of revolution having a volume corresponding to a predetermined ground bath weight and open at its two ends, the upper opening 26 being connected to the ground bath hopper 5, the lower opening 26 being connected to a supply tube 22, an axial rod 28 connected in its upper part to a jack 29 being equipped with a lower stopper 30 and an upper stopper 31, which are spaced from one another by a distance $d_2$ less than the distance $d_1$ between openings 26 and 27 with which each stopper 30,31 alternately cooperates in a tight relationship, stoppers 30 and 31 being made from a flexible material.

9. Apparatus according to claim 8, wherein the flexible material constituting the stoppers 30 and 31 is selected from the group consisting of synthetic elastomers, synthetic elastomers reinforced with steel wires and equivalent alloys.

* * * * *